United States Patent [19]

Jacox

[11] Patent Number: 4,685,249

[45] Date of Patent: Aug. 11, 1987

[54] INDUSTRIAL AIR FILTER DOOR WITH STANDARD HANDLE-DOG ACTUATION

[76] Inventor: John W. Jacox, 5874 Northern Pine Pl., Columbus, Ohio 43229

[21] Appl. No.: 854,167

[22] Filed: Apr. 21, 1986

[51] Int. Cl.[4] ..... E05C 9/00

[52] U.S. Cl. ..... 49/395; 292/241

[58] Field of Search ..... 49/395; 292/241

[56] References Cited

U.S. PATENT DOCUMENTS

| | | | |
|---|---|---|---|
| 436,330 | 9/1890 | Beaumont . | |
| 1,064,278 | 6/1913 | Beaver . | |
| 1,468,081 | 9/1923 | Ross . | |
| 2,156,635 | 5/1939 | Mascuch | 114/117 |
| 2,295,324 | 9/1942 | Arthur | 292/48 |
| 2,335,450 | 11/1943 | Sandberg | 61/83 |
| 2,440,764 | 5/1948 | Wilson | 189/46 |
| 2,613,406 | 10/1952 | Dean | 292/241 X |
| 4,262,447 | 4/1981 | Schneier | 49/254 |

*Primary Examiner*—Kenneth Downey

*Attorney, Agent, or Firm*—Mueller and Smith

[57] ABSTRACT

Disclosed is a door and closure assembly ideally adapted for use as an industrial air filter door with handle and dog actuation. The assembly comprises a door frame and a door having an outside surface and an inside surface. The door is hingedly attached to the frame at a side edge of the door. A plurality of closure means for securing the door to the frame are provided. The closure means comprises a handle located at the outside surface of the door; a dog located on the inside surface of the door; a rotatable shaft penetrating through said door and connecting said handle and said dog; door frame retention means cooperative with the dog for securing the door to the frame; and stop means disposed and cooperating with said retention means so that the handle and dog rotate in one direction only to secure the door and only in the opposite direction to unsecure the door. All of the handles are disposed in substantially the same position when the door is secure or unsecure.

11 Claims, 5 Drawing Figures

INDUSTRIAL AIR FILTER DOOR WITH STANDARD HANDLE-DOG ACTUATION

BACKGROUND OF THE INVENTION

The present invention relates to industrial air filter and like doors with standard handle-dog actuation and more particularly to a much improved handle-dog actuation assembly and system.

Industrial air filter doors, marine bulkhead doors, and like doors are required to be air tight, water tight, or tight with respect to both air and water. It will be appreciated that reference to air and water are illustrative of fluids, vapors and liquid, from which a variety of doors must provide effective sealing. In nuclear power plant confines, for example, air filter doors are part of the containment system and, thus, must provide a predetermined effective seal with respect to the passage of air and gases through the opening to which they provide closure. Similar requirements are placed upon marine bulkhead doors which must be water tight for obvious reasons. It will be appreciated that other industrial environments similarly require door and closure systems which are leak-proof, yet are easy to access for maintenance, servicing, and like needs.

In the industrial air filter door environment, it often is necessary to provide access through the door for servicing air filters, for example. Nuclear power plants, for example, may contain literally hundreds of these air filter doors which are required to meet certain minimum governmental specifications. Unfortunately, the typical maintenance worker who accesses these doors often does not exercise the requisite degree of care required for maintaining the integrity of the door seal and door closure mechanisms. Often, the handles become rusted (oxidized), exhibit a lack of lubrication, are painted and re-painted, or otherwise become quite difficult to actuate. Often, the worker will employ a length of pipe or a wrench for providing increased leverage for actuating the closure mechanism. Damage to the mechanism often results.

Another problem often encountered is to figure out which way to rotate the handle in order to unlock the door. While this may seem an elementary problem, it should be understood that each door often will have six or more closure mechanisms which quite frequently do not rotate in the same direction for opening and closing each of the mechanisms. This uncertainty as to which direction to rotate the handle is exacerbated when coupled with the frequent rusting and lack of lubrication which is encountered. Often, the worker will struggle mightily with a length of pipe for rotating the handle only to discover later that he was forcing the handle in the wrong direction. No indicia on the outside of the door is correlative with the position of the handle, i.e. whether the mechanism is in an open or a closed position.

Another problem frequently encountered is that the seal about the door becomes damaged due to the dog or handle being forced against the seal. This can happen because frequently the closure mechanism is so loose that it will not stay in a given position. This means that gravity forces the handle to be in a downward position. If the downward position of the handle translates into a closed position of the mechanism, the handle must be held in an upwardly-disposed position in order for the door to be opened. With a six foot door having six or more of such loose mechanisms, it will be appreciated that a worker working alone has a great deal of difficulty in opening or closing the door since he has but two hands. In forcing the door shut under such circumstances, often the dog or handle scrapes across the seal, thus destroying its integrity and the integrity of the door for its intended purposes.

Prior proposals aimed at providing air tight or water tight doors include U.S. Pat. Nos. 2,440,764, 2,156,635, 2,335,450, 1,468,081, 1,064,278, and 2,295,324. The ultimate listed patent provides a complex and expensive closure actuating and locking mechanism which operates by a single handle on the outside of the door. While such door may find favor in submarines, its complexity and cost make it prohibitive in most industrial and marine applications.

Thus, it will be observed that a simple, yet reliable industrial door with actuation assembly is required. The present invention addresses this long felt need in industry.

BROAD STATEMENT OF THE INVENTION

The present invention is directed to a door and closure means which comprises a door frame, a door having an outside surface and an inside surface which door is hingedly attached to the door frame at a side edge thereof, and a plurality of closure means for securing the door to the frame. The closure means comprise a handle located on the outside surface of the door; a dog located on the inside surface of the door; and a rotatable shaft penetrating through said door and connecting said handle and said dog. Retention means are provided to be cooperative with the dog for securing the door to the frame. Stop means are disposed and cooperate with the retention means so that the handle and dog rotate in one direction only to secure the door and only in the opposite direction to unsecure the door. All of the handles are disposed the same when the door is secure or unsecure.

Another aspect of the present invention comprises a universal adaptor which enables conventional door mechanisms to be retrofitted for operation in accordance with the present invention. A special dog and handle assembly can be used with the universal adaptor or can be used in the manufacturing of new door assemblies. These and other aspects of the present invention will be fully set forth herein.

Advantages of the present invention include a door closure system which is simple, yet reliable in use. A further advantage is a door closure system which is constructed to provide visible indicia to the worker as to the status of the door, vis a vis, whether it is in a secure or an unsecure condition. Another advantage is a door closure system which is designed to minimize seal damage occurrences. These and other advantages will be readily apparent to those skilled in the art based upon the disclosure contained herein.

These drawings will be described in detail below.

DETAILED DESCRIPTION OF THE INVENTION

The door closure system of the present invention is unique in its ability to provide a rugged, yet reliable closure mechanism capable of functioning in severe environments. Coupled with the ruggedness and reliability built into the door closure system is the status cuing which permits a worker to ascertain the status of the door, vis a vis, its being secure or unsecure. Such visible indicia or status cuing is unique in this art. Further, the door closure system is designed to be relatively easy for a single worker to operate and minimizes the opportunity for the door closure system to damage the door seal.

Figure 1:
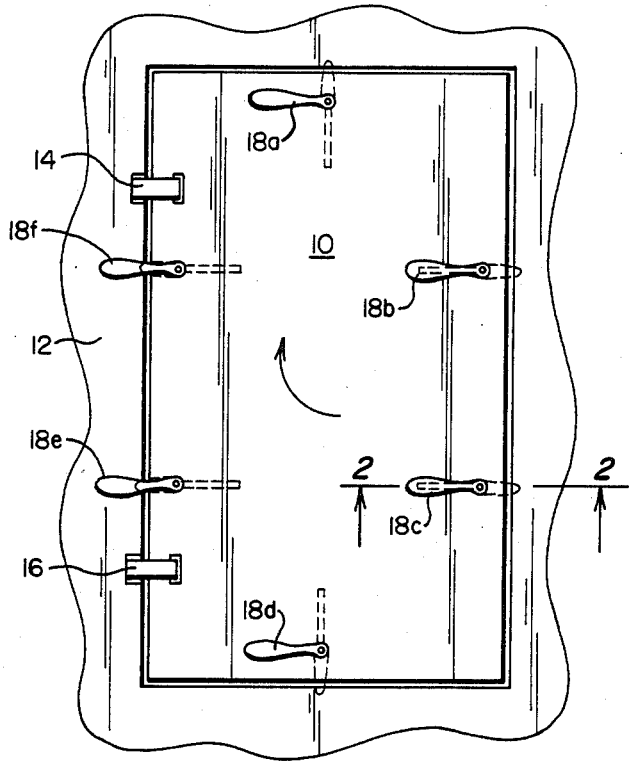
FIG. 1 is an elevational view of the outside of the inventive door and closure means.

Referring to FIG. 1, door 10 is seen to be hingedly attached to frame 12 via upper hinge 14 and lower hinge 16 which are disposed at one side edge of door 10. Six closure mechanisms are disposed about door 10, two about each side edge and one each at the top edge and bottom edge of door 10. From the outside of door 10 one can see handles 18*a*—18*f*. The closure mechanisms are in a closed position and the corresponding dog and handle disposed on the inside of door 10 are shown in phantom. Of importance is the fact that each of handles 18—18*f* are disposed in substantially the same position to provide visible indicia of the status of the door with respect to it being in a secure or unsecure condition. The provision of status cuing for door 10 is a unique element to the present invention.

Figure 4:
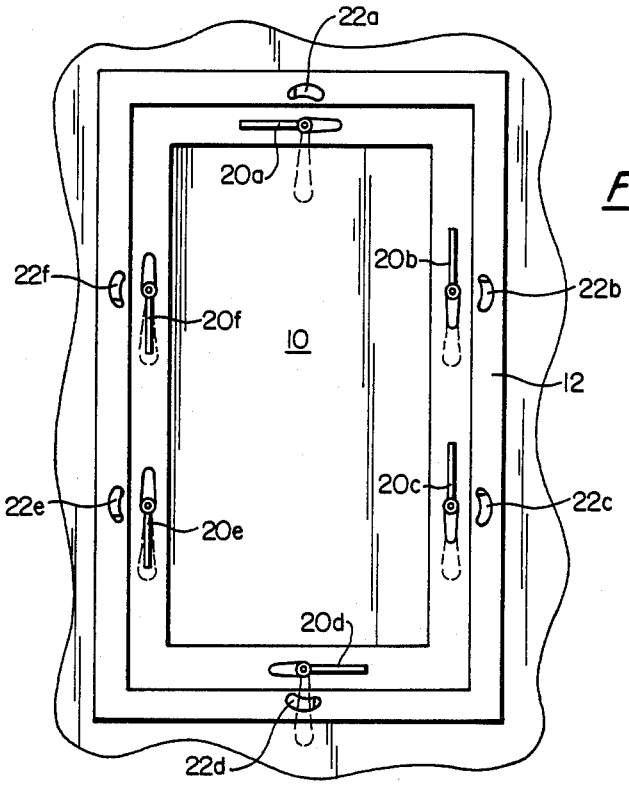
FIG. 4 is an elevational view of the inside of the inventive door and closure means wherein the closure means are in an open position.

Referring to FIG. 4, the inside of door 10 is revealed as are the corresponding interior parts of the closure mechanisms. The interior portion of the closure mechanisms are comprised of handle and dogs 20*a*—20*f*. The dog and handle assemblies are shown in an open position so that the door is unsecure. The corresponding position of handles 18—18*f* are represented in phantom. With respect to the position of handles 18—18*f*, it is important to note that each of the handles is in the same, downwardly-disposed position providing status cuing that the door is in an unsecure position. Also, interior dog and handle assemblies 20*a* —20*f* are disposed in such a position so that they do not interfere with frame 12 and are disposed so that inadvertant contact with the door seal is minimized.

Associated with each interior dog and handle assembly 20*a*—20*f* are retention and stop means 22*a*—22*f*, respectively. The retention and stop means are engaged by a dog for securing or closing door 10. Advantageously, each handle 18 and corresponding interior handle and dog assembly 20 is weighted so that when the door is in an unsecure condition, the positions depicted at FIG. 4 are favored. For example, handle 18*a* should be of sufficient weight so that it remains in the downwardly disposed position while interior dog and handle assembly 20*a* remains in the horizontally disposed position. The same is true for handle 18*d* and interior dog and handle 20*d*. Handles 20*b* and 20*c* along with their corresponding dog from interior handle and dog assembly 20*b* and 20*c*, respectively, are weighted so that the vertically disposed position depicted at FIG. 4 is maintained when the closure mechanism is open. Handle 20*e* and 20*f* along with the interior handle portion of interior handle and dog assembly 22*e* and 22*f*, respectively, are weighted so that the position depicted at FIG. 4 is maintained when the closure mechanism is in an unsecure position. By this weighting scheme, each closure mechanism is ensured to remain in an open position so that it is unhindered by frame 12 and any risk of damage to the door seal is minimized. Also, a single worker can easily secure and unsecure the door without having to stretch across the expanse of door 10 trying to hold two or more mechanisms in a desired position in order to open or close door 10.

Figure 2:
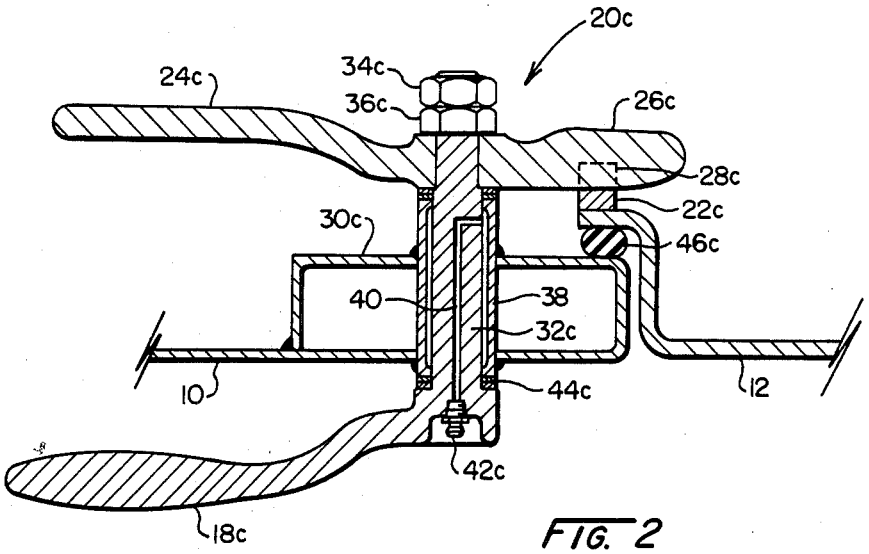
FIG. 2 is a cross-sectional elevational view of one of the closure means of FIG. 1 taken along line 2—2.

The construction of handle 18*c* and its corresponding interior handle and dog 20*c* is depicted at FIG. 2. Each of the other closure assemblies is manufactured substantially the same as the construction set forth at FIG. 2, except for the relative position of the outside handle with respect to the inside handle and dog, as will be described in further detail below. Referring to FIG. 2, it will be observed that interior handle and dog assembly 20*c* is composed of interior handle 24*c* and dog 26*c*. When this closure mechanism is in the closed or secure position, dog 28*c* is in secure contact with closure 22*c* which has stop 28*c* (shown in phantom). Closure 22*c* typically is in the form of an inclined plane for tensioning dog 26*c* thereagainst for preventing the closure mechanism from inadvertantly coming open. With stop 28*c*, handle 18*c* and handle 24*c* can be rotated in one direction only for securing the closure mechanism and in one direction only for unsecuring the mechanism.

Channel 30*c* is disposed on the interior of door 10 and provides extra strength and rigidity for the closure mechanism. Handle 18*c* is seen to be manufactured integrally with rotating shaft 32*c*, though a two piece construction certainly is feasible. Shaft 32*c* penetrates through door 10 and channel 30*c* and fits through an opening in interior handle and door assembly 20*c* for securement by nuts 34*c* and 36*c*. The use of a double nut assembly ensures that the mechanism will not come apart inadvertently. Rotating shaft 32*c* fits within sleeve 30*a* which similarly penetrates through an opening in door 10 and channel 30*c*. An anular cavity is created between shaft 32*c* and sleeve 38 which along with passageway 40 provides a grease seal system for the mechanism wherein grease from a conventional grease gun can be forced into passageway 40 via seal 42*c* formed in handle 18*c*. Excess grease from the anular passageway created between sleeve 38 and shaft 32*c* flows out of opening 44*c* disposed adjacent handle 18*c*. It is not desired to have any excess grease flow to the inside of door 10 since door 10 is desired to be utilized as an air filter door in nuclear power plant installations wherein it becomes part of the nuclear containment system. Should any lubricant flow to the inside of door 10, it may become contaminated by gaseous-borne radioactive contamination. Thus, excess lubricant should flow to the outside of door 10 as provided for in the inventive closure mechanism. Finally, seal 46 is seen to be disposed between channel 30*c* and frame 12. Seal 46*c* is composed of a resilient material such as rubber, plastic, or like gasket material of suitable composition for its intended use.

Figure 3:
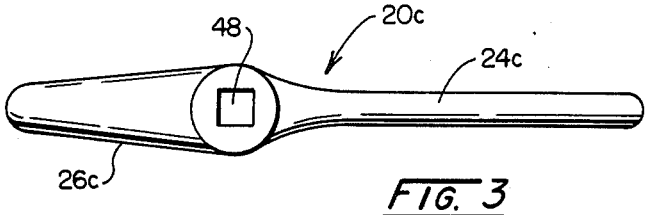
FIG. 3 is an overhead plan view of a standard dog and interior handle unit of the present invention.

As noted above, each of the closure mechanisms disposed about door 10 is manufactured substantially in the same manner as described with respect to FIG. 2 but for the relative disposition between handle 18*c* and interior handle 24*c* and dog 26*c*. Representative interior handle and dog assembly 20*c* is set forth at FIG. 3. This assembly is typical of the other interior handle and dog assemblies 22*a*—22*f*. It will be observed that rectangular hole 48 penetrates through assembly 22*c* for fitting about the end of shaft 32*c*. With the end of shaft 32*c* manufactured in a complementary rectangular configuration, assembly 22*c* can be mounted in four different configurations with respect to outside handle 18*c* for providing the various positions shown in FIGS. 1 and 4. Thus, a single universal interior handle and dog assembly has been designed for use in accordance with the precepts of the present invention.

Figure 5:
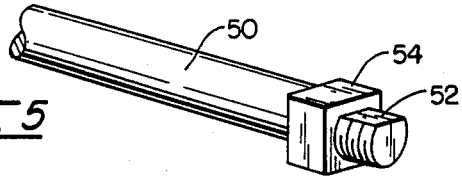
FIG. 5 is a perspective view of a portion of the rotatable shaft of the closure means having a universal adaptor fixed thereto.

In retrofitting existing door assemblies which have an exterior handle and an attached rotating shaft (integral or as two pieces), often the inside end of the shaft will have a flat as shown for shaft 50 having flat 52 at FIG. 5. Flat 52 accomodates standard dog and handle assemblies. Such shaft can easily be adapted to be utilized in accordance with the inventive closure mechanism of the present invention via rectangular adaptor 54. Rectangular adapter 54 has a corresponding flat for mating tightly against flat 52 while the remainder of the hole penetrating therethrough it circular to accomodate the circular shape of the tip of shaft 50. It will be observed that universal adapter 54 is designed so that shaft 48 of assembly 22*c* can fit thereon. A locking screw or other conventional means can be used to retain adapter 54 securely mounted on shaft 50. Now, assembly 22*c* can be disposed in four different positions with respect to a handle disposed at the opposite end of shaft 50 for making the inventive closure mechanism of the present invention. Thus, utilizing interior handle and dog assembly 22*c* in combination with universal adapter 54, virtually any existing door closure mechanism can be retrofitted for operation in accordance with the present invention. The only other modification perhaps necessary involves the provision of the retention and stop means (e.g. retention means 22*c* and stop means 28*c*) which may need to be charged so that uniformity with respect to the rotation of the assembly is determined by the disposition of the retention and stop means. This, too, is easy to accomplish for retrofitting existing doors to operate with the inventive closure system of the present invention.

Materials of construction, typically comprehend metal and often corrosion resistance dictates stainless steel, galvanized steel, or like materials of construction be used. Sleeve 38 may be composed of metal or may be composed of plastic or similar polymeric material, provided that the material can withstand the environment with which it will be in contact during use. The same is true of the lubricant which is conventional in composition depending upon the precise location and performance specifications required of the door and closure assembly.

While the invention has been described with particularity for an industrial air filter door, the door and closure assembly easily can be adapted for use in marine and other environments as is necessary, desirable, or convenient. Also, the number of closure mechanisms about the door may be in greater or lesser number than the six depicted in the drawings.

I claim:

1. A door and closure assembly comprising:

(a) a door frame;

(b) a door having an outside surface and an inside surface which door is hingedly attached to said frame at an edge thereof; and (c) a plurality of closure means for securing said door to said frame, said closure means comprising a handle located at the outside surface of the door; a dog located on the inside surface of the door; a rotatable shaft penetrating through said door and connecting said handle and said dog; door frame retention means cooperative with said dog for securing said door to said frame; and stop means disposed and cooperating with said retention means so that said handle and dog rotate in one direction only to secure said door and only in the opposite direction to unsecure said door, all of said handles being disposed in substantially the same position when said closure means are secure or unsecure.

2. The door and closure assembly of claim 1 wherein said outside surface located handle is disposed downwardly when said closure means are in an unsecure position.

3. The door and closure assembly of claim 1 wherein said dog has a handle associated therewith for forming a dog and handle assembly.

4. The door and closure assembly of claim 2 wherein said closure means is constructed so that gravity retains said handle in a downwardly disposed condition when said closure means is in an unsecure condition.

5. The door and closure assembly of claim 3 wherein said closure means is constructed so that gravity retains said handle in a downwardly disposed condition when said closure means is in an unsecure condition.

6. The door and closure assembly of claim 3 wherein said dog and handle assembly are elongately disposed with a central opening therebetween for receiving said rotating shaft.

7. The door and closure assembly of claim 6 wherein said central opening is a rectangular opening.

8. The door and closure assembly of claim 1 wherein closure means are located at each side edge of said door and at the top and bottom edge of said door.

9. The door and closure assembly of claim 8 wherein when said closure means are in an unsecure condition, said dog and handle assembly disposed at the side edges of said doors are vertically disposed while said dog and handle assemblies at the top and bottom edges of said door are horizontally disposed.

10. The door and closure assembly of claim 1 which is constructed of metal.

11. The door and closure assembly of claim 7 wherein an adapter having a rectangular exterior configuration is secured about an end of said rotatable shaft and said dog and handle assembly are secured to said adapter.

* * * * *